US007954516B2

(12) United States Patent
Hallundbaek

(10) Patent No.: US 7,954,516 B2
(45) Date of Patent: Jun. 7, 2011

(54) CLADDING METHOD AND EXPANSION TOOL

(76) Inventor: Jørgen Hallundbaek, Graested (DK)

( * ) Notice: Subject to any disclaimer, the term of this patent is extended or adjusted under 35 U.S.C. 154(b) by 0 days.

(21) Appl. No.: 12/597,659

(22) PCT Filed: Apr. 28, 2008

(86) PCT No.: PCT/DK2008/000159

§ 371 (c)(1),
(2), (4) Date: Oct. 26, 2009

(87) PCT Pub. No.: WO2008/131771

PCT Pub. Date: Nov. 6, 2008

(65) Prior Publication Data

US 2010/0058828 A1 Mar. 11, 2010

(30) Foreign Application Priority Data

Apr. 26, 2007 (DK) ..... PA 2007 00616

(51) Int. Cl.
*F16L 55/16* (2006.01)

(52) U.S. Cl. ..... 138/98; 138/97; 166/207; 156/294; 156/287; 264/269; 264/36.1; 264/516

(58) Field of Classification Search ..... 138/98, 138/97; 166/207, 384; 264/269, 36, 516; 156/294, 287; 405/150.1, 184.1
See application file for complete search history.

(56) References Cited

U.S. PATENT DOCUMENTS 2,695,255 A * 11/1954 Avery ..... 156/165
4,950,446 A * 8/1990 Kinumoto et al. ..... 264/516
4,995,929 A * 2/1991 Menzel ..... 156/187
5,368,809 A * 11/1994 Steketee, Jr. ..... 264/516
(Continued)

FOREIGN PATENT DOCUMENTS

GB 2402952 12/2004
(Continued)

OTHER PUBLICATIONS

International Preliminary Report on Patentability prepared by WIPO dated Oct. 27, 2009.

*Primary Examiner* — Patrick F Brinson
(74) *Attorney, Agent, or Firm* — Cohen Pontani Lieberman & Pavane LLP

(57) ABSTRACT

A cladding method for sealing a leak in a casing, a pipeline, a borehole, or a well downhole using a liner having a tube with a first diameter, a plurality of circumferential grooves, and a plurality of seals in the grooves extending beyond the first diameter. The cladding method has at least the steps of fastening the liner in a fastening mechanism of an expansion tool, inserting the liner having a first part and a second part into the casing outside the leak, positioning an expansion mechanism of the expansion tool at the first part of the liner, expanding the first part of the liner until the seals in the grooves of the first part of the liner are pressed against the casing and fasten the first part to the casing, releasing the liner so that the liner is free of the tool and the liner is held in place by the seals in the first part of the liner, and expanding all the way through the liner by expanding also the second part of the liner to abut the casing for sealing the leak.

14 Claims, 10 Drawing Sheets

U.S. PATENT DOCUMENTS

| | | | | |
|---|---|---|---|---|
| 5,456,319 | A | 10/1995 | Schmidt et al. | 166/373 |
| 6,070,671 | A * | 6/2000 | Cumming et al. | 166/381 |
| 7,182,141 | B2 | 2/2007 | Tran et al. | 166/384 |
| 2003/0106698 | A1 | 6/2003 | Simpson et al. | 166/382 |
| 2004/0065446 | A1 * | 4/2004 | Tran et al. | 166/384 |
| 2004/0112609 | A1 | 6/2004 | Whanger et al. | 166/380 |
| 2004/0168796 | A1 * | 9/2004 | Baugh et al. | 166/207 |
| 2004/0173360 | A1 * | 9/2004 | Harrall et al. | 166/382 |
| 2004/0244994 | A1 * | 12/2004 | Jackson et al. | 166/384 |
| 2005/0121202 | A1 * | 6/2005 | Abercrombie Simpson et al. | 166/380 |
| 2006/0000617 | A1 * | 1/2006 | Harrall et al. | 166/380 |
| 2006/0196678 | A1 * | 9/2006 | Connell et al. | 166/380 |

FOREIGN PATENT DOCUMENTS

| | | |
|---|---|---|
| GB | 2415001 | 12/2005 |
| GB | 2431181 | 4/2007 |
| WO | WO02/086285 | 10/2002 |
| WO | WO2004/099561 | 11/2004 |
| WO | WO 2005/003511 | 1/2005 |

* cited by examiner

CLADDING METHOD AND EXPANSION TOOL

PRIORITY CLAIM

This is a U.S. national stage of application No. PCT/DK2008/000159, filed on Apr. 28, 2008. Priority is claimed on the following application: Denmark Application No.: PA 200700616, filed on Apr. 26, 2007, the content of which is incorporated here by reference.

TECHNICAL FIELD

The present invention relates to a cladding method for sealing a leak in a casing, pipeline, a borehole, or a well downhole using a liner. Furthermore, the invention relates to an expansion tool.

BACKGROUND

In the event that a casing downhole has a leek, a tube, also called a liner or a clad, having a smaller diameter than the casing is usually placed outside the leak. The liner is then expanded from inside the tube to increase the diameter of the tube to match the diameter of the casing so as to seal the leak in the casing.

A liner is usually made of metal, and usually of the same metal as the casing. When the liner has been expanded to match the diameter of the casing and the expansion tool is retracted from within the liner, the liner will shrink a bit due to the tension in the metal. In this way, the diameter of the liner is somewhat smaller than that of the casing. Therefore, when rolling the liner, the liner is expanded to a larger diameter than the original diameter of the casing. This is obtained by rolling both the liner and the casing to a somewhat larger diameter so that, when the expansion tool is retracted, both the liner and the casing shrink, and the liner is thus able to seal the teak in the casing.

However, expanding the liner into a larger diameter than that of the casing is only possible in the event that the casing can also be expanded. Usually, cement is used to fasten the casing, and the casing is thus surrounded by cement. In this case, the casing cannot be expanded, and rolling the liner will result in a small gap between the outside of the liner and the inside of the casing—and the leak is thus not sealed by the liner.

Known solutions to this problem have been to make a liner of epoxy mixed with fibre glass where the liner is curled, the cross-section of the liner thus being shaped like a flower. In this way, the liner can be uncurled when rolled to abut the inside of the casing, and due to the fact that epoxy does not shrink, the liner will be able to seal the leak as intended.

Another solution to this problem is known from US 2005/057005 in which the liner has projections that, during expansion of the liner, are fastened to the inside of the casing. This is also known from US 2006/0237188. However, these projections may break off, the result being that the liner is released and the leak is not sealed.

In order to insert the liners into the casing or the like, the whole liner needs to have a external diameter greater than that of the casing. When expanding the liner only some of the liner is expanded, e.g. the first part, whereas the second part is not expanded. The result is that the diameter of the casing is decreased in those areas where the liner is not expanded. Thus, the leak in the casing may be sealed, but the fluid flow in the casing or pipeline is substantial decreased making the casing less efficient than before the leak occurred.

DESCRIPTION OF THE INVENTION

An aspect of the present invention is, at least partly, to overcome the disadvantages of the cladding methods mentioned above, and to provide an improved cladding method with which it is possible to seal a leak in a casing by means of a liner without decreasing an internal diameter of the casing.

This aspect and the advantages becoming evident from the description below are obtained by a cladding method for sealing a leak (2) in a casing (3), a pipeline, a borehole, or a well downhole using a liner (1) having a tube (4) with a first diameter and a plurality of sealing means (6) in a plurality of circumferential grooves (5), comprising the steps of:

- fastening the liner in a fastening means of an expansion tool,
- inserting the liner having a first part and a second part into the casing outside the leak,
- positioning an expansion means of the expansion tool at the first part of the liner,
- expanding the first part of the liner until the sealing means in the grooves of the first part of the liner are pressed against the casing and fasten the first part to the casing,
- releasing the liner so that the liner is free of the tool and the liner is held in place by the sealing means in the first part of the liner, and
- expanding all the way through the liner by expanding also the second part of the liner to abut the casing for sealing the leak.

By using a cladding method of the present invention, the entire liner is expanded from an initial diameter to a larger second diameter fitting the internal surface of the casing. Thus, when the tool leaves the liner in the casing, the diameter is the same along the entire extension of the liner, the diameter is moreover only somewhat smaller than the internal diameter of the casing. Hereby, the leak in the casing is sealed without substantial narrowing the internal diameter of the casing and thus without substantially diminishing the flow of the fluid flowing inside the casing.

In one embodiment, the cladding method may further comprise the step of retracting the expansion tool between expansion of the first and the second part of the liner. Furthermore, the expansion means may be mandrel.

In another embodiment, the expansion means may be a body with rollers.

In addition, the expansion means may have a cone where part of the cone has a larger diameter than that of a non-expanded liner and that part of the cone extends outside the liner before expansion of the liner.

Also, the sealing means may be a ring with a ring diameter and a centre, such as an O-ring.

In one embodiment, the sealing means may curl seen from the ring diameter towards the centre, allowing the ring to be straightened out to a larger diameter than the original ring diameter when expanded.

In addition, the sealing means may be made of silicone, natural or syntactic rubber, polymer, or the like.

The invention further relates to an expansion tool for expanding a liner for sealing a leak in a casing from within the casing using a liner, comprising

- at least one fastening means for fixing a first part of the liner and for holding the liner in place outside the leak during expanding, an expanding means for expanding the liner to a larger diameter from a second part of the liner all the way through the liner.

In one embodiment of the expansion tool, the expansion means may be a mandrel.

In another embodiment of the expansion tool, the expansion means may be a body with rollers.

Furthermore, the expansion means may have a cone where part of the cone has a larger diameter than that of a non-expanded liner and that part of the cone extends outside the liner before expansion of the liner so that the cone can uphold the liner when inserting the liner into the casing.

In addition, the expansion means may be moved away from the expansion tool in order to expand the liner.

Also, the expansion means may be retracted into the expansion tool in order to expand the liner.

Finally, the fastening means may be connected to a shaft penetrating the expansion means in its centre.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
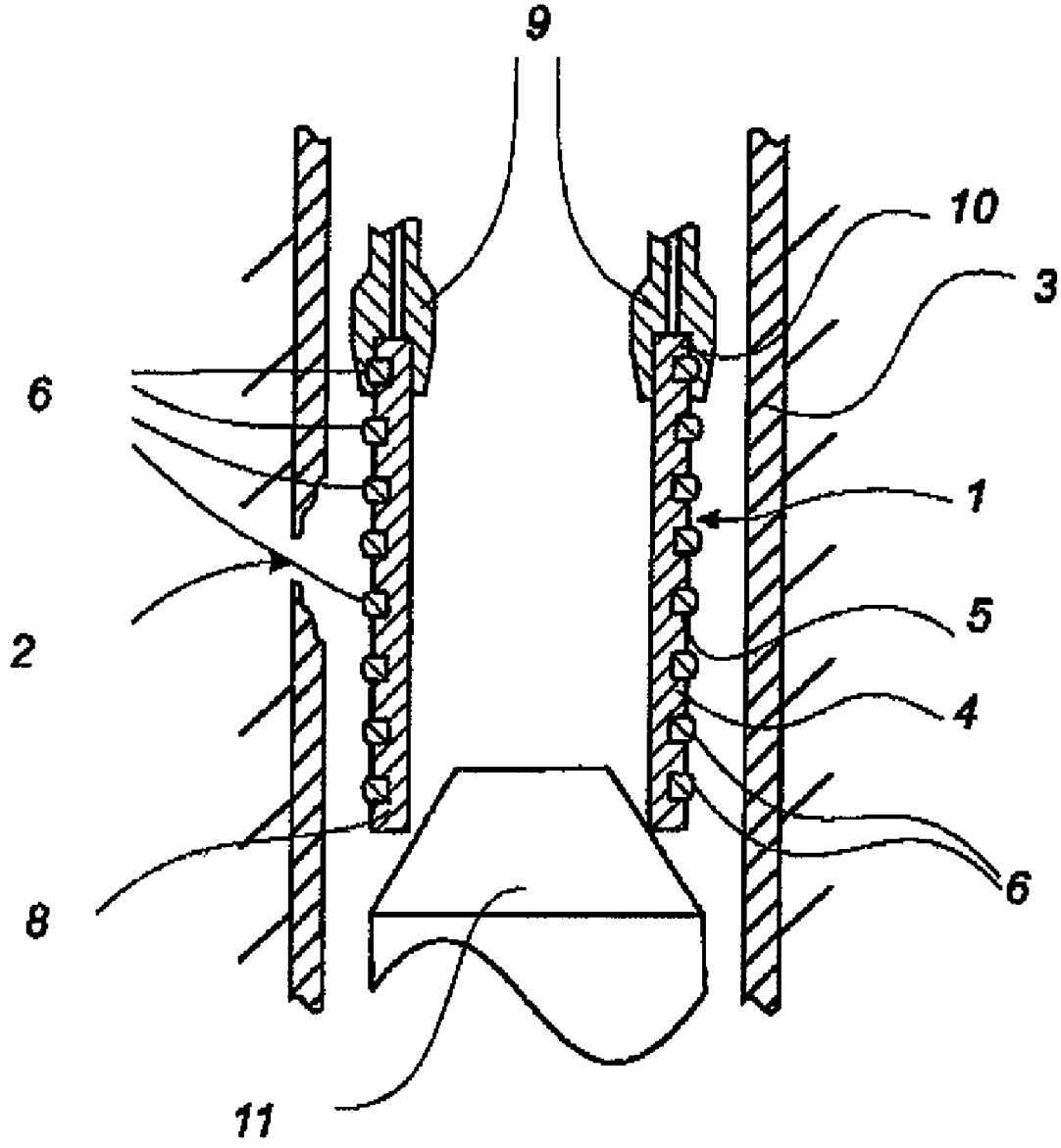
FIG. 1 shows a liner held by a tool within a casing before expanding.

In FIG. 1, a liner 1 is shown positioned within a casing 3 downhole. The casing 3 has a leak 2 indicated by an arrow. In this case, the casing 3 is cemented into the subterranean formation. The liner 1 according to the invention can be used in all kinds of casings 3 which has not been cemented into the formation or directly into the borehole.

The liner 1 is shown used in a casing 3; however, the liner 1 may also be used in another cavity, such as a pipeline, a borehole, or a well downhole. A casing 3 is placed inside a borehole for transporting fluid, such as oil, a mix of oil with water, gas, etc. In many drilling operations for making the borehole, the fluid is mixed with filtrate or other additives in order to improve the drilling process. Furthermore, the fluid may contain other elements, such as cuttings, swarf, sand, pipe dope, remains from a previous explosion, rust from the casing in the well, or detachments torn-off from the well, the casing, or the formation. In the following, the invention will be explained with reference to a casing 3 conveying oil fluid.

The liner 1 comprises a tube 4 with circumferential grooves 5. A sealing means 6, such as an O-ring, is provided in each groove 5 extending somewhat outside the groove 5 so that the tube 4 has a larger second outside diameter where the grooves 5 with the sealing means 6 are positioned.

At one end, the liner 1 is held by fastening means or gripping means 9. The fastening means or gripping means 9 grip around the circumferential wall 7 of the tube 4 in a second part 10 of the liner 1. At the other end of the liner 1, a mandrel 11 is shown before expanding of the liner 1.

Figure 2:
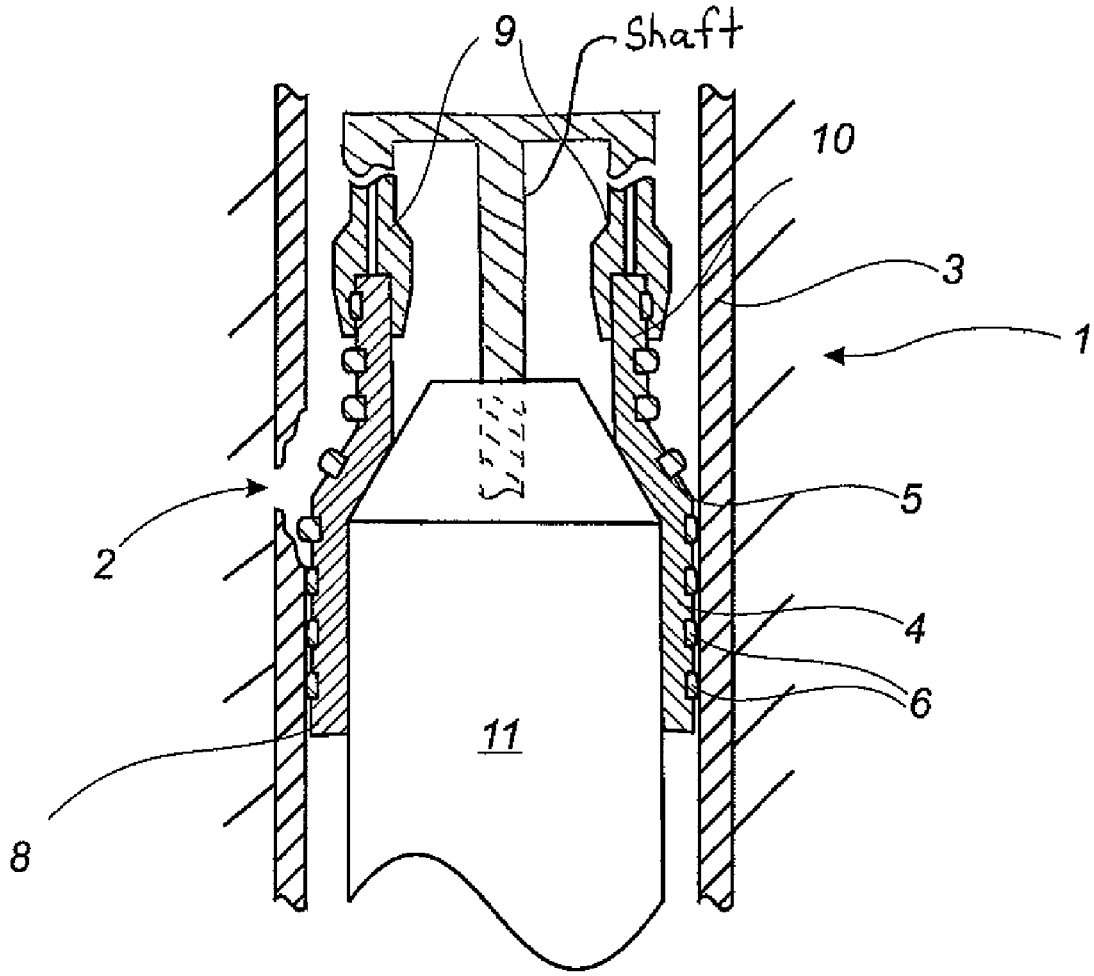
FIG. 2 shows the liner of FIG. 1 where a first part of the liner has been expanded.

In FIG. 2, the liner 1 has been partly rolled or expanded. The mandrel 11 has been moved upwards for expanding the liner 1 from a first diameter to a second, expanded diameter. As can be seen from FIG. 2, in the first, expanded part 8 of the liner 1, the sealing means 6 has been squeezed between the inside wall of the casing 3 and the outside wall of the liner 1. This is due to the fact that the liner 1 has been expanded by the mandrel 11 so that the outside wall of the liner 1 abuts the inside wall of the casing 3.

Figure 3:
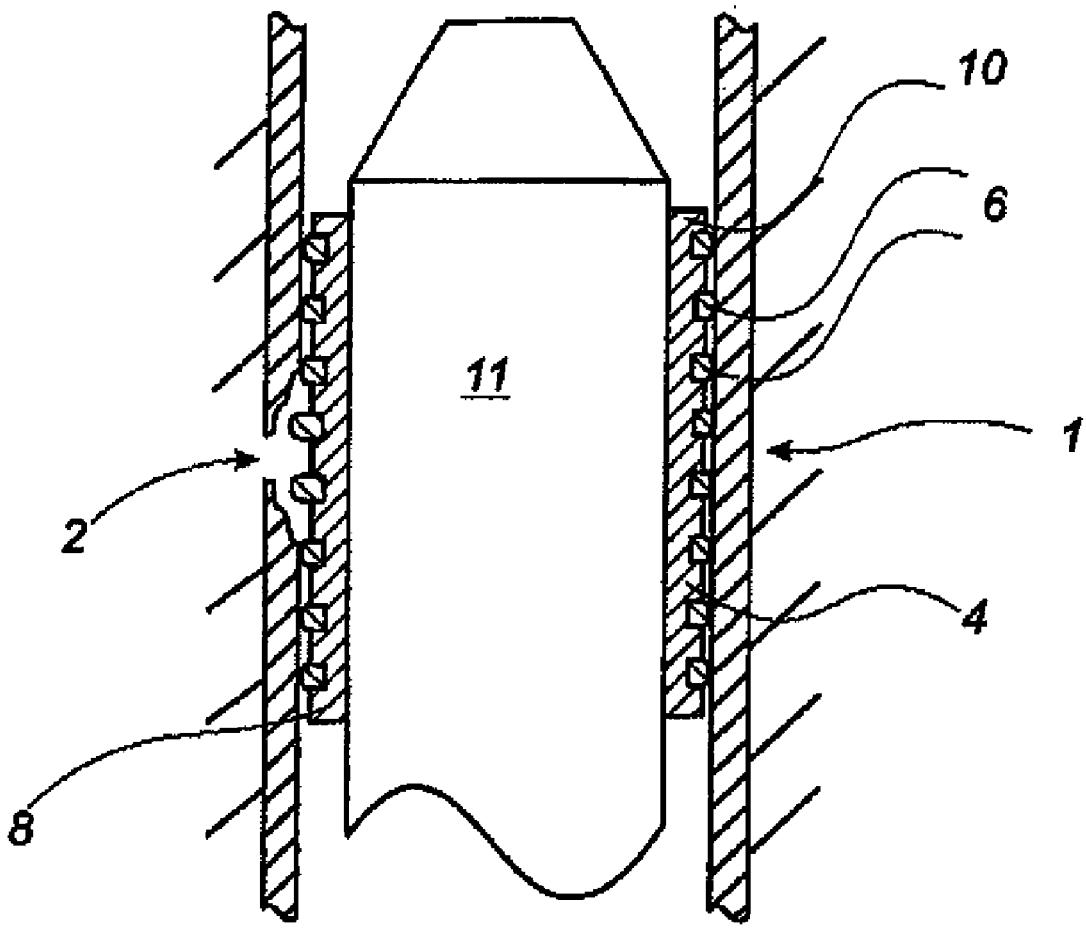
FIG. 3 shows the liner of FIGS. 1 and 2 where the whole liner has been expanded.

The second part 10 of the liner 1 cannot yet be expanded since the fastening means or gripping means 9 holds the liner 1. Therefore, when the liner 1 has been partly expanded, the fastening means or gripping means release 9 the liner 1, and the liner 1 is held in place by the friction between the sealing means 6 and the inside wall of the casing 3. Subsequently, the mandrel 11 can expand the rest of the liner 1, that is, the second part 10, as shown in FIG. 3. Thus, the liner 1 is able to uphold itself in the casing 3 while the rest of the liner 1 is expanded by the expansion means which expands the whole liner 1 without having to expand the casing 3.

The liner 1 is cladded inside the casing 3 for sealing of a leak 2 in the casing 3. Firstly, a second part 10 of the liner is fastened in some fastening means 9 or gripping means 9 of an expansion tool and the liner 1 is inserted in the casing 3 outside the leak 2. Secondly, the first part 8 of the liner 1 is expanded until the sealing means 6 in the grooves 5 of the first part 8 of the liner 1 are pressed against the easing 3 and fasten the first part 8 to the casing 3. Then, the liner 1 is released from the fastening means 9 so that the second part 10 of the liner 1 is no longer held by the tool and the liner 1 is held in place by the sealing means 6 in the first part of the liner Finally, the second part 10 of the liner 1 is also expanded and the liner 1 has thus been expanded along its entire extension to abut the casing 3 for sealing the leak 2.

The sealing means 6 is fastened to the casing 3 due to the friction between the sealing means 6 and the casing 3, and in this way the liner 1 is able to uphold itself and hold itself in position when the second part 10 of the liner 1 is expanded so that no fastening means 6 is needed. In this way, the expansion means is able to penetrate and thereby expand the whole liner 1 without needing to expand the casing also.

By sealing a leak 2 by means of the present cladding method, the leak 2 in the casing 3 is sealed without substantially reducing the internal diameter of the casing 3 due to the fact that the entire liner 1 is expanded to a larger diameter and not only part of the liner.

Figure 4:
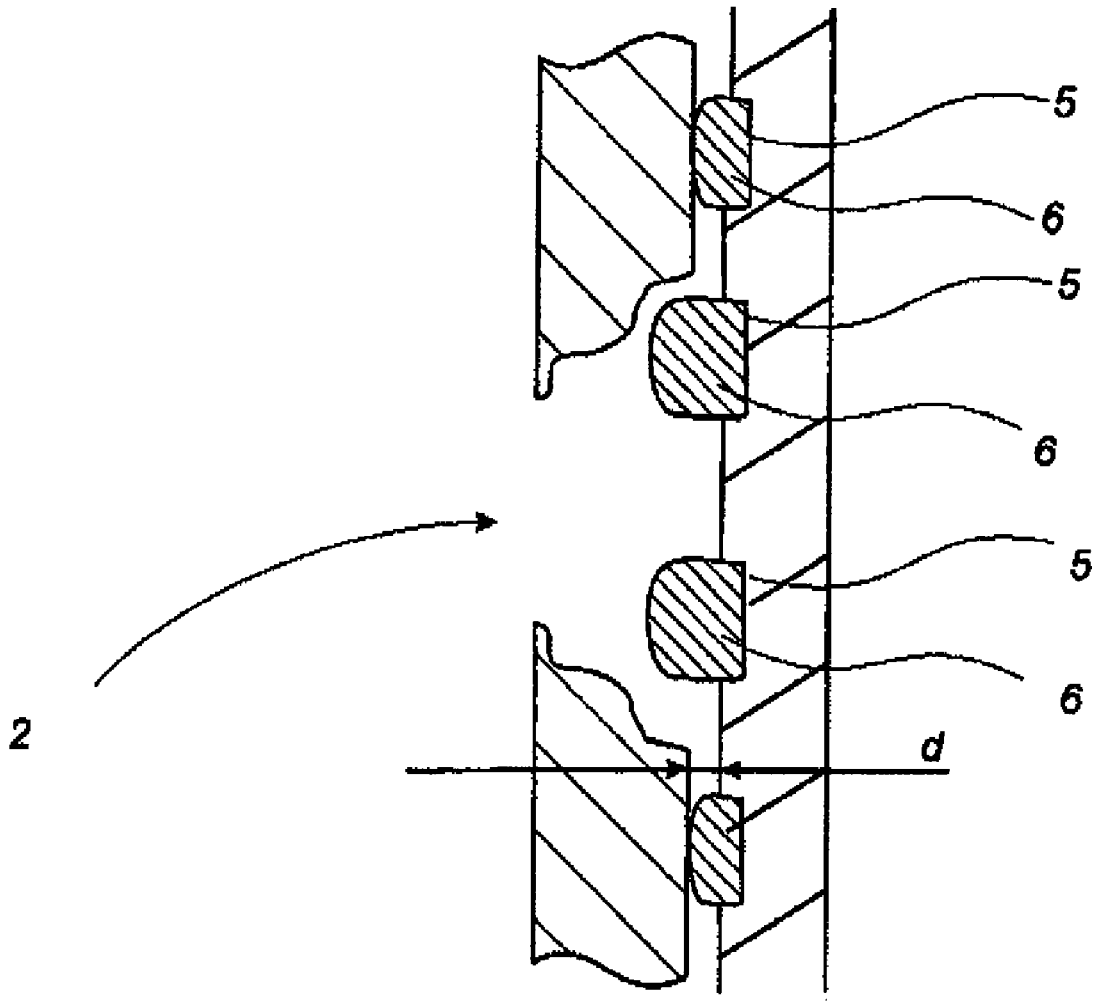
FIG. 4 shows a sectional view of FIG. 3 around the leak of the casing.

When the mandrel 11 is still inside the liner 1, the outside wall of the liner 1 abuts the inside wall of the casing 3. However, at the moment the mandrel 11 is retracted, the liner 1 will, if made of some kind of metal, shrink somewhat due to the tension in the metal. In FIG. 4, a sectional view of the expanded liner 1 outside the casing 3 is shown. The mandrel 11 has been retracted from inside the liner 1, and the liner 1 has somewhat shrunk, so that a small gap d has been created between the liner 1 and the casing 3. However, the sealing means 6 has expanded correspondingly so as to fill up this gap d and thus seal the leak 2.

Figure 5:
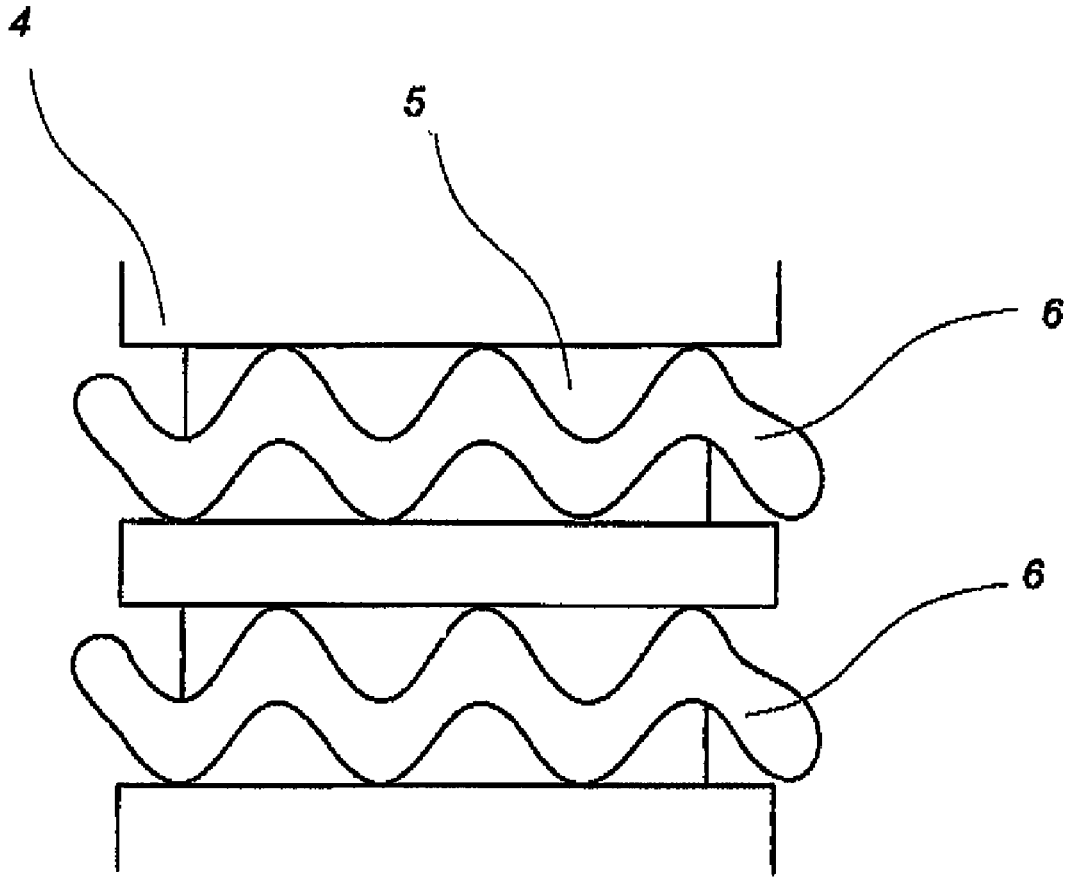
FIG. 5 shows sealing means within some grooves.

As shown in FIG. 5, the sealing means 6 may be shaped like a ring which curls seen from the diameter towards the centre of the ring. In this way, the ring may expand when the liner 1 is expanded to a larger diameter than the initial diameter of the liner 1. When the liner 1 is expanded, the ring will be straightened out.

The number of sealing means 6 is determined by how much force is needed for expanding the rest of the liner 1 when the fastening means or gripping means 9 have released the liner f. However, the sealing means 6 may vary in diameter and the cross-section of the ring may be oval as well as circular. The larger the diameter, the more able the sealing means 6 are to expand, and an oval shape may increase the friction area between the sealing means 6 and the inside well of the casing 3. Thus, the number of sealing means 6 may also in part be determined by the size and shape of the sealing means 6.

The invention also relates to an expansion tool for expanding the liner 1 within the casing 3 to seal a leak 2 in the casing 3. The tool comprises two fastening means or gripping means 9 gripping around the second part 10 of the liner 1 as shown in FIG. 1. The tool further comprises an expansion means such as the mandrel 11 shown in FIG. 2 which expands the liner 1 from a first diameter to a second, larger diameter. The fastening means or gripping means 9 is connected to a shaft penetrating the mandrel 11 at its centre.

Figure 6:
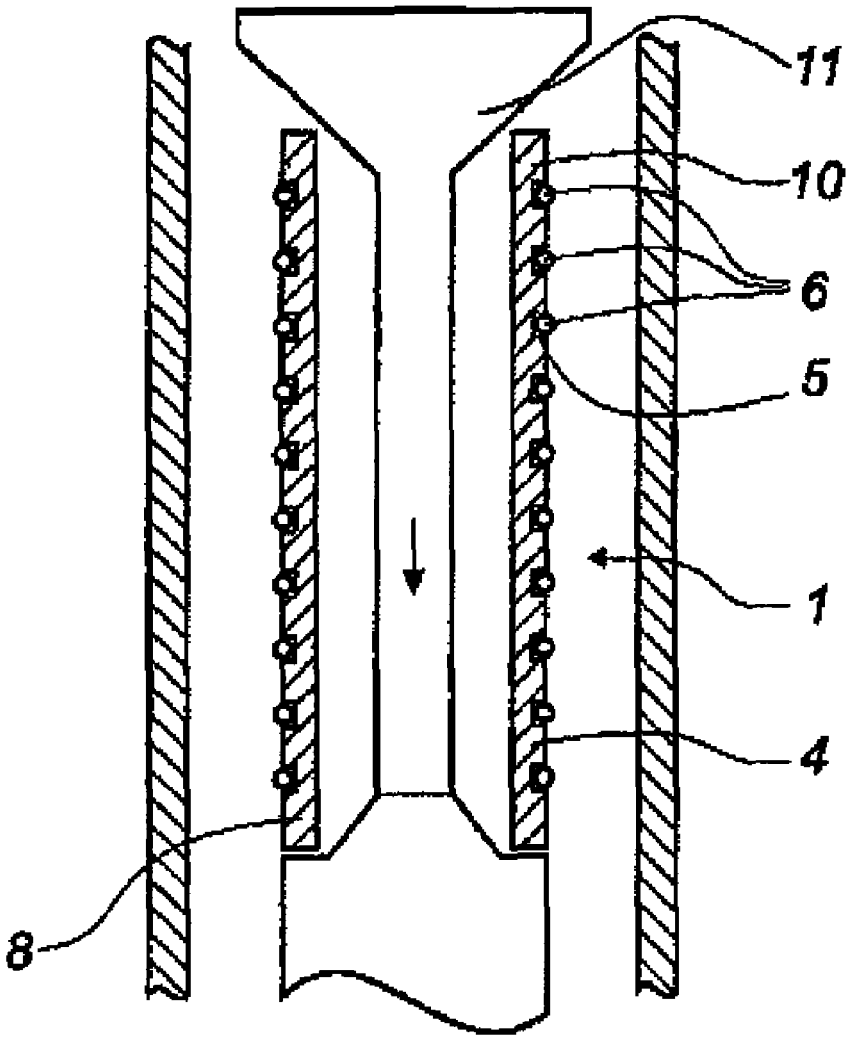
FIG. 6 shows an expansion tool having fastened a liner within a casing.

In another embodiment, the expansion means is a body with rollers. In yet another embodiment, the expansion means has a cone as shown in FIG. 6. A first part of the cone has a larger diameter than that of a non-expanded liner 1 so as to be able to expand the liner 1 when the cone is moved in the direction of the tool. The first part of the cone extends outside the liner 1 before expanding the liner 1 so that the liner 1 is fastened between the cone and a body of the expansion tool. In this way, the expansion tool end the cone can uphold the liner 1 when inserting the liner 1 in the casing 3.

Figure 7:
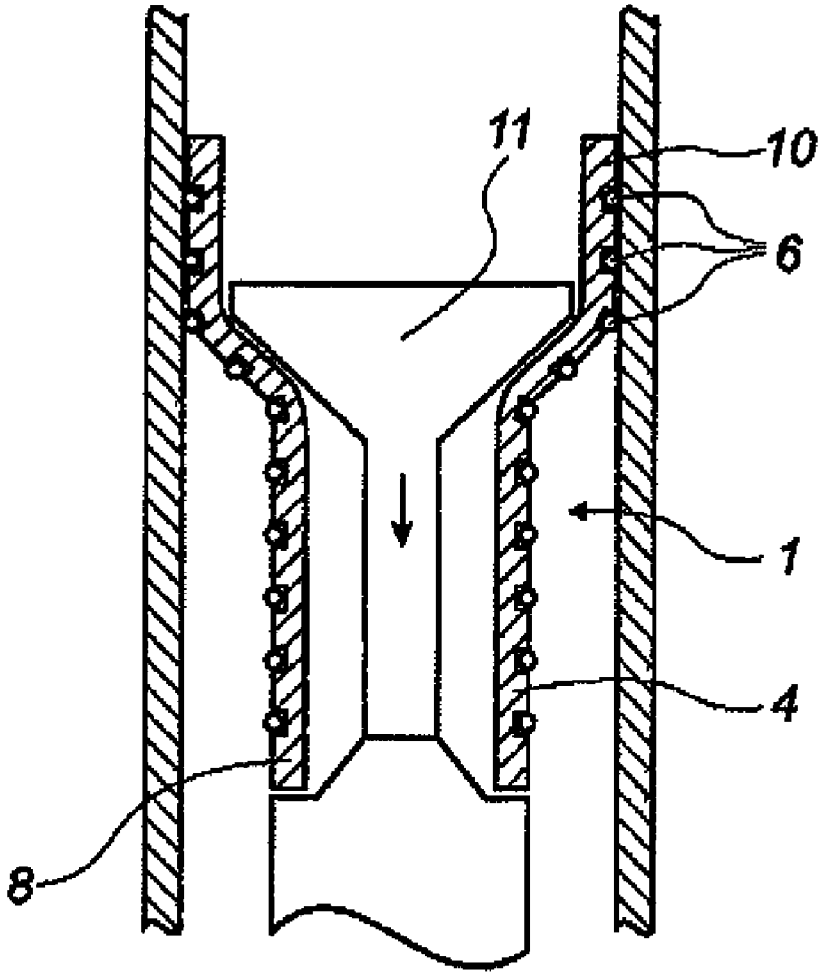
FIG. 7 shows the expansion tool of FIG. 6 expanding the liner.

After the liner 1 has been fastened, it is inserted into the casing 3 outside the leak 2 to be sealed. In this embodiment, the positioning of the expansion tool takes place at the same time as the fastening of the liner 1 in the expansion tool. Subsequently, the expansion means of the expansion tool expands the first part 8 of the liner 1 as shown in FIG. 7 by retracting the shaft onto which the cone is positioned into the expansion tool. The movement of the expansion means is shown by an arrow.

Figure 8:
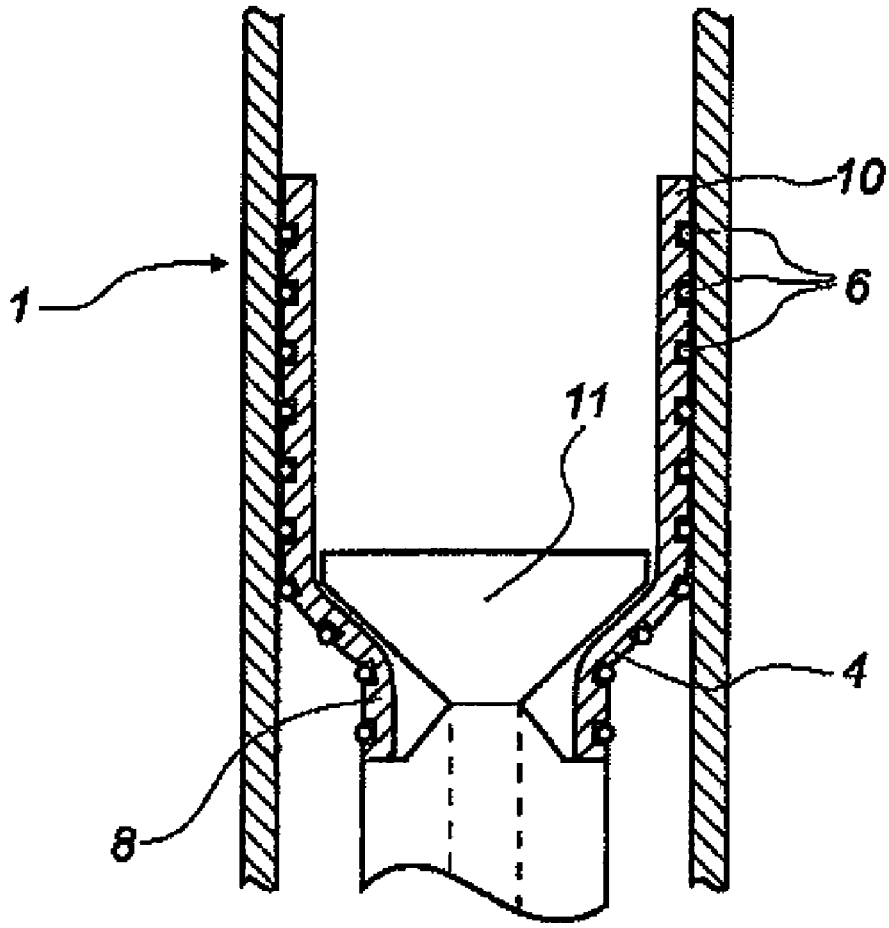
FIG. 8 shows the expansion tool of FIGS. 6 and 7 expanding the liner even further.
Figure 9:
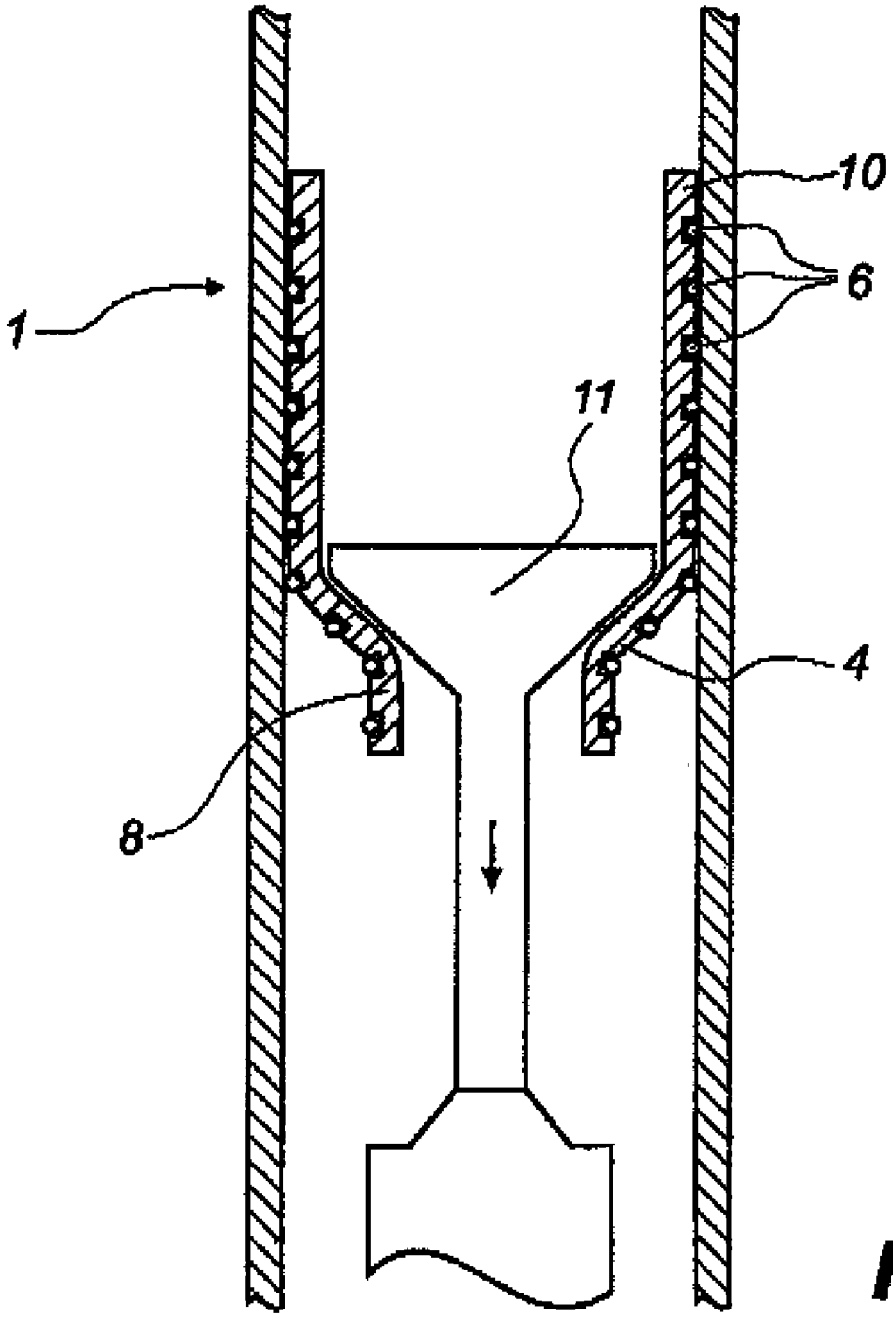
FIG. 9 shows the expansion tool of FIGS. 6, 7 and 8 before the rest of the liner is expanded.
Figure 10:
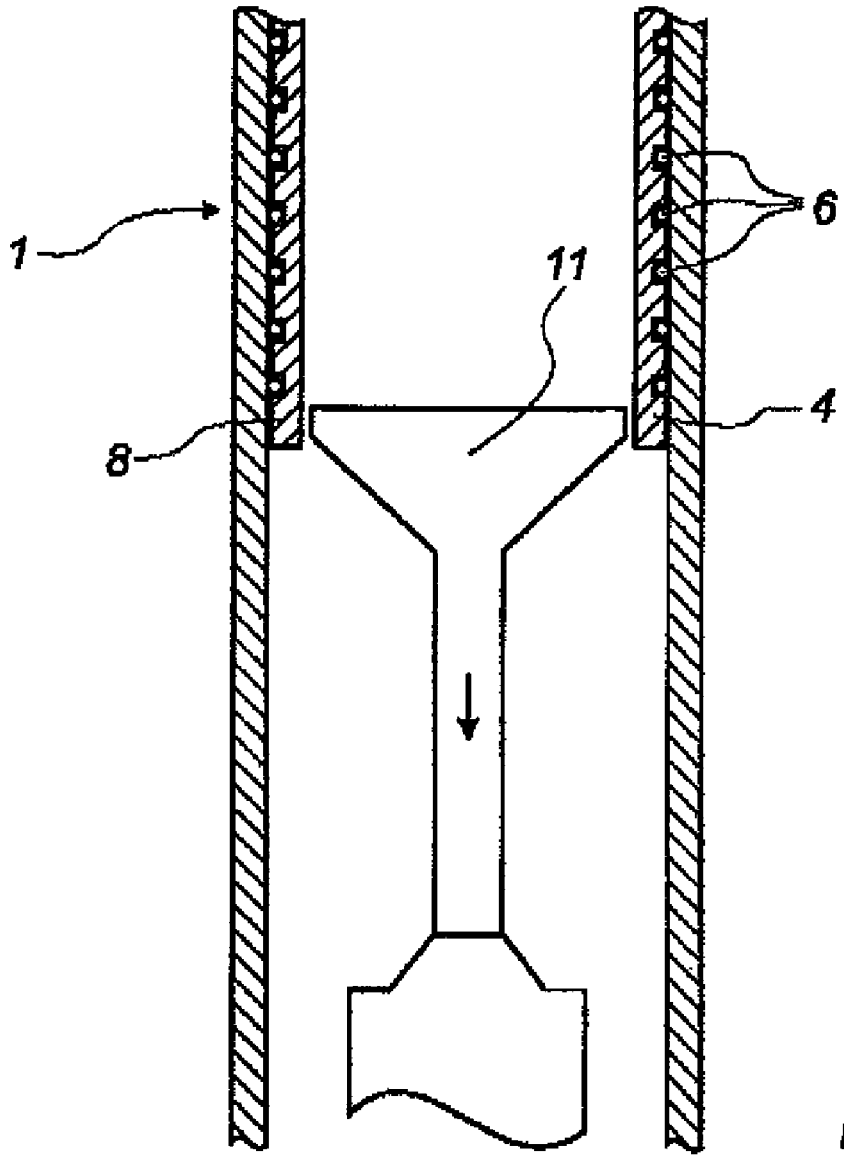
FIG. 10 shows the expansion tool of FIG. 9 after the entire liner has been expanded.

In FIG. 8, the shaft is retracted so that the cone abuts the body of the expansion tool. Then, as shown in FIG. 9, the body of the expansion tool is moved away from the liner 1 releasing the liner 1 while the cone stays in the liner 1 whereby the shaft is pulled out of the body again. Finally, the cone expands the rest of the liner 1, i.e. the second part 10 of the liner 1. In FIG. 10, the entire liner 1 has been expanded.

The expansion tool is held in place inside the casing 3 by means of anchors, slips, or the like means. Such means may be positioned either in the expansion tool or in another, connected tool. The expansion tool may also be held in place inside the casing 3 by means of a downhole tractor.

By liner 1 is meant any form of sealing element used to cover or seal a leak on the inside of a casing 3, such as a lining, a liner, a clad, a seal, or the like.

In the event that the expansion tool is not submergible all the way into the casing 3, a downhole tractor can also be used to push the expansion tool all the way into position in the casing 3 or the well. A downhole tractor is any kind of driving tool capable of pushing or pulling tools in a well downhole, such as a Well Tractor®.

The invention claimed is:

1. A cladding method for sealing a leak in a casing, a pipeline, a borehole, or a well downhole using a liner having a tube with a first diameter and a plurality of sealing means in a plurality of circumferential grooves, comprising the steps of:

fastening the liner in a fastening means of an expansion tool, inserting the liner having a first part and a second part into the casing outside the leak, positioning an expansion means of the expansion tool at the first part of the liner, expanding the first part of the liner until the sealing means in the grooves of the first part of the liner are pressed against the casing and fasten the first part to the casing, releasing the liner so that the liner is free of the tool and the liner is held in place by the sealing means in the first part of the liner, and expanding all the way through the liner by expanding also the second part of the liner to abut the casing for sealing the leak.

2. The cladding method according to claim 1, further comprising the step of retracting the expansion tool between expansion of the first and the second part of the liner.

3. A cladding method for sealing a leak in a casing, a pipeline, a borehole, or a well downhole using a liner having a tube with a first diameter and a plurality of sealing means in a plurality of circumferential grooves, comprising:

fastening the liner in a fastening means of an expansion tool;

inserting the liner having a first part and a second part into the casing outside the leak;

positioning an expansion means of the expansion tool at the first part of the liner;

expanding the first part of the liner until the sealing means in the grooves of the first part of the liner are pressed against the casing and fasten the first part to the casing;

releasing the liner so that the liner is free of the tool and the liner is held in place by the sealing means in the first part of the liner; and expanding all the way through the liner by expanding also the second part of the liner to abut the casing for sealing the leak, wherein the expansion means is a mandrel.

4. The cladding method according to claim 1, wherein the expansion means is a body with rollers.

5. A cladding method for sealing a leak in a casing, a pipeline, a borehole, or a well downhole using a liner having a tube with a first diameter and a plurality of sealing means in a plurality of circumferential grooves, comprising:

fastening the liner in a fastening means of an expansion tool;

inserting the liner having a first part and a second part into the casing outside the leak;

positioning an expansion means of the expansion tool a the first part of the liner;

expanding the first part of the liner until the sealing means in the grooves of the first part of the liner are pressed against the casing and fasten the first part to the casing;

releasing the liner so that the liner is free of the tool and the liner is held in place by the sealing means in the first part of the liner; and expanding all the way through the liner by expanding also the second part of the liner to abut the casing for sealing the leak, wherein the expansion means has a cone where part of the cone has a larger diameter than that of a non-expanded liner and that part of the cone extends outside the liner before expansion of the liner.

6. The cladding method according to claim 1, wherein the sealing means is a ring with a ring diameter and a centre.

7. The cladding method according to claim 6, wherein the sealing means curls, as seen from the ring diameter towards the centre, allowing the ring to be straightened out to a larger diameter than the original ring diameter during expansion.

8. The cladding method according to claim 1, wherein the sealing means is made of silicone, natural or synthetic rubber, polymer, or the like.

9. An expansion tool for expanding a liner for sealing a leak in a casing from within the casing using a liner, comprising:

at least one fastening means for fixing a first part of the liner and for holding the liner in place outside the leak during expanding; and an expansion means for expanding the liner to a larger diameter from a second part of the liner all the way through the liner, wherein the expansion means is one of a mandrel and a body with rollers.

10. The expansion tool according to claim 9, wherein the expansion means is the body with rollers.

11. An expansion tool for expanding a liner for sealing a leak in a casing from within the casing using a liner, comprising:

at least one fastening means for fixing a first part of the liner and for holding the liner in place outside the leak during expanding;

an expansion means for expanding the liner to a larger diameter from a second part of the liner all the way through the liner, wherein the expansion means is a mandrel and has a cone where part of the cone has a larger diameter than that of a non-expanded liner and that part of the cone extends outside the liner before expansion of the liner so that the cone can uphold the liner when inserting the liner into the casing.

12. The expansion tool according to claim 9, wherein the expansion means is moved away from the expansion tool while expanding the liner.

13. An expansion tool for expanding a liner for sealing a leak in a casing from within the casing using a liner, comprising:

at least one fastening means for fixing a first part of the liner and for holding the liner in place outside the leak during expanding;

an expansion means for expanding the liner to a larger diameter from a second part of the liner all the way through the liner, wherein the expansion means is a mandrel that is retracted into the expansion tool while expanding the liner.

14. The expansion tool according to claim 9, wherein the fastening means is connected to a shaft penetrating the expansion means in its centre.

* * * * *